US006871578B1

(12) United States Patent
Onishi et al.

(10) Patent No.: US 6,871,578 B1
(45) Date of Patent: Mar. 29, 2005

(54) HIGH-PRESSURE FUEL SUPPLY APPARATUS

(75) Inventors: Yoshihiko Onishi, Tokyo (JP); Kouichi Ojima, Tokyo (JP)

(73) Assignee: Mitsubishi Denki Kaibushiki Kaisha, Tokyo (JP)

( * ) Notice: Subject to any disclaimer, the term of this patent is extended or adjusted under 35 U.S.C. 154(b) by 221 days.

(21) Appl. No.: 10/111,228

(22) PCT Filed: Aug. 24, 2000

(86) PCT No.: PCT/JP00/05705

§ 371 (c)(1),
(2), (4) Date: Aug. 7, 2002

(87) PCT Pub. No.: WO02/16756

PCT Pub. Date: Feb. 28, 2002

(51) Int. Cl.[7] ..... F02M 59/44
(52) U.S. Cl. ..... 92/129; 92/168
(58) Field of Search ..... 92/129, 168

(56) References Cited

U.S. PATENT DOCUMENTS 2,079,821 A * 5/1937 Scribner ..... 92/129
2,322,356 A * 6/1943 Hahn ..... 92/129
2,802,003 A * 10/1957 Staege ..... 92/168
4,526,150 A * 7/1985 Guntert et al. ..... 123/447

FOREIGN PATENT DOCUMENTS

| | | |
|---|---|---|
| JP | 63-14863 U | 1/1988 |
| JP | 8-68370 | 3/1996 |
| JP | 11-159416 | 6/1999 |

* cited by examiner

*Primary Examiner*—Thomas E. Lazo
(74) *Attorney, Agent, or Firm*—Sughrue Mion, PLLC

(57) ABSTRACT

The object of the present invention is to provide a high-pressure fuel supply apparatus, in which the durability of the fuel sealing section is improved and additionally the evaluation time is reduced. The high-pressure fuel supply apparatus comprises a piston having a plunger supported slidably within a cylinder and a tappet, a casing for preventing the fuel leaking out of the space between the cylinder and the piston from leaking outside by surrounding substantially the cylinder and the piston, and a sealing means for sealing the space between the casing and the piston, wherein the sealing means is fastened to the casing and brought into a slidable contact with the tappet of the piston. The sealing means may either be brought into slidingly contact with the cylindrical surface of the tappet that is fitted in the plunger or be brought into contact with a columnar tappet that simply abuts against one end of the plunger and is supported by the casing in a way in which it can move axially but it does not move radially. The tappet may be made of ceramics.

4 Claims, 4 Drawing Sheets

HIGH-PRESSURE FUEL SUPPLY APPARATUS

TECHNICAL FIELD

This invention relates to a high-pressure fuel supply apparatus, and in particular to a high-pressure fuel supply apparatus for supplying high-pressure fuel to an internal combustion engine.

BACKGROUND ART

A fuel supply system of the fuel injection type in an internal combustion engine for automobiles is generally the like shown in FIG. 3, wherein fuel 2 in a fuel tank 1 is sent out of the fuel tank 1 by a low-pressure pump 3, filtered through a filter 4 and, following receiving pressure adjustment by a low-pressure regulator 5, supplied to a high-pressure fuel supply apparatus 6, or a high-pressure pump. Fuel is rendered high pressure by the fuel supply apparatus 6 only in the quantity necessary for fuel injection and supplied into common rails 9 of an internal combustion engine (not shown). The remainder of the fuel is released through an electromagnetic valve 17 into the space between a low-pressure damper 12 and a suction valve 13. The quantity necessary for fuel injection is determined by a regulation unit (not shown), which also regulates the electromagnetic valve 17. The high-pressure fuel thus supplied is injected in high-pressure spray into a cylinder (not shown) of an internal combustion engine from a fuel injection valve 10 connected to the common rails 9. A filter 7 and a high-pressure relief valve 8 open in the event of unusual pressures within the common rails 9 (the high-pressure relief valve opening pressures) to prevent the failure of the common rails 9 and the fuel injection valve 10.

The high-pressure fuel supply apparatus 6, or a high-pressure pump, comprises a filter 11 for filtering the supplied fuel, the low-pressure damper 12 for absorbing the pulses of low-pressure fuel, and a pump 16 that applies pressure to the fuel supplied through the suction valve 13 and discharges the high-pressure fuel through a discharge valve 14 and a fuel pressure holding valve 15. As shown in FIG. 4, a fuel pressuring room 24 constituted by a plunger 26, a sleeve 25 and a plate 102 of the pump 16 plus the suction valve 13 and the discharge valve 14 is linked to the space between the low-pressure damper 12 and the suction valve 13 via the electromagnetic valve 17.

FIG. 4 shows the details of a structure of a conventional high-pressure fuel supply apparatus like the high-pressure fuel supply apparatus 6. In FIG. 4, the high-pressure fuel supply apparatus 6 is provided with a cylindrical sleeve, or a cylinder 25 that forms inside thereof the pressuring room 24 being accommodated within a casing 21 and having a suction port 22 and a discharge port 23 for fuel. Within the cylinder 25, the plunger 26 that is supported slid ably in the line of the axis for making the volume the pressuring room 24 variable within the cylinder 25 is disposed, and a compression spring 27 is disposed at the inner end (the upper end in the Figure) of the plunger 26, and at the outer end (the lower end in the Figure) thereof a working member, or a tappet 28, that receives a driving force from outside through an unillustrated engine camshaft and transmits the driving force to the plunger is fitted and fastened. Thus, the plunger 26 and the tappet 28 constitute a piston 29 of the high-pressure fuel supply apparatus 6.

In FIG. 4, the high-pressure fuel supply apparatus 6 comprises integrally the pump 16, or a plunger pump, the electromagnetic valve 17 connected to the pressuring room 24 and the low-pressure damper 12.

The high-pressure fuel supply apparatus 6 also comprises a casing 30 for preventing the fuel leaking out of the space between the cylinder 25 and the piston 29 from leaking outside by surrounding substantially the cylinder 25 and the piston 29, and a sealing means 31 made of rubber for sealing the space between the casing 30 and the plunger 26 of the piston 29.

A high-pressure fuel supply apparatus like the high-pressure fuel supply apparatus 6, in which the plunger piston 29 is driven up and down in FIG. 4 by the driving cam disposed coaxially with the unillustrated engine camshaft sucks up and discharges fuel. During the process, through the opening of the electromagnetic valve 17 at the time when a certain quantity of fuel has been discharged into the common rails 9, the high-pressure fuel in the pressuring room 24 is released to the suction side at a lower pressure, and then no fuel is pumped into the common rails 9. Through the control of the timing of opening of the electromagnetic valve 17, the discharge from the fuel supply apparatus 6 is variably adjusted and controlled.

In the conventional high-pressure fuel supply apparatus thus constructed 6, the piston 29 for applying pressure to fuel is used as the member on the shaft side, and as the member on the opposing side a sealing member 31 made of rubber is disposed in the sealing means 31 for preventing fuel in the high-pressure fuel supply apparatus 6 from leaking into the engine room. For the prevention of abrasion of the seal 31, an oil film is formed in the sealing section at the part where the plunger 26 that leads fuel or engine oil during the reciprocation of the piston 29 comes into contact with the lips of the rubber sealing means 31 so that the seal 31 does not wear away.

Because the structure like this is a structure allowing and utilizing a certain level of minor leakage rather than providing a perfect sealing, there are such problems as a significant variance of the lubrication condition in the sealing section, occurrence of abrasion of the sealing section and an increase in the quantity of leakage, depending on the condition of the surface of the sealing section on the shaft side, the speed of movement of the shaft, the shape and interference of the rubber lips and the state of fuel and engine oil around the lips.

Further, in the high-pressure fuel supply apparatus 6, the piston 29 applying pressure to fuel is the most important part, and so a great deal of time is needed in evaluation. As to durability in particular, abrasion with and seizure to the sleeve 25 that constitutes the fuel pressuring room 24 together with the piston 29 and is engaged with the piston 29 with a certain level of space in-between pose a problem. In the event of occurrence of such a problem in the sealing section in a conventional apparatus like this, it is necessary to evaluate concurrently the effect of the piston 29 on the abrasion with and seizure to the sleeve 25, and a great deal of time is needed in evaluation. In addition, because of the generation of a limitation in the measures for the side of the piston 29, a further time is needed in evaluation.

The present invention therefore has as its object the provision of a high-pressure fuel supply apparatus, in which the durability of the fuel sealing section is improved and additionally the evaluation time is reduced.

DISCLOSURE OF INVENTION

The present invention is a high-pressure fuel supply apparatus comprising a cylinder provided with a pressuring room having a suction port and an injection port for fuel, a piston having a plunger that is supported slidably so that the volume of the pressuring room is variable within the cylinder and a working member being made to have a relation with the plunger for transmitting the driving force to the plunger upon receiving the driving force from outside, a casing for preventing the fuel leaking out of the space between the cylinder and the piston from leaking outside by surrounding substantially the cylinder and the piston, and a sealing means for sealing the space between the casing and the piston, wherein the sealing means is fastened to the casing and brought into slidingly contact with the working member of the piston.

The working member may be formed as a tappet fitted in the plunger, and the sealing means may be brought into slidingly contact with the cylindrical surface of the tappet.

The working member may be formed as a columnar member that is disposed in one end of the plunger abuttingly and supported by the casing in a way in which it can move axially but it does not move radially.

The working member may be a member made of ceramics.

BEST MODES FOR CARRYING OUT THE INVENTION

Figure 1:
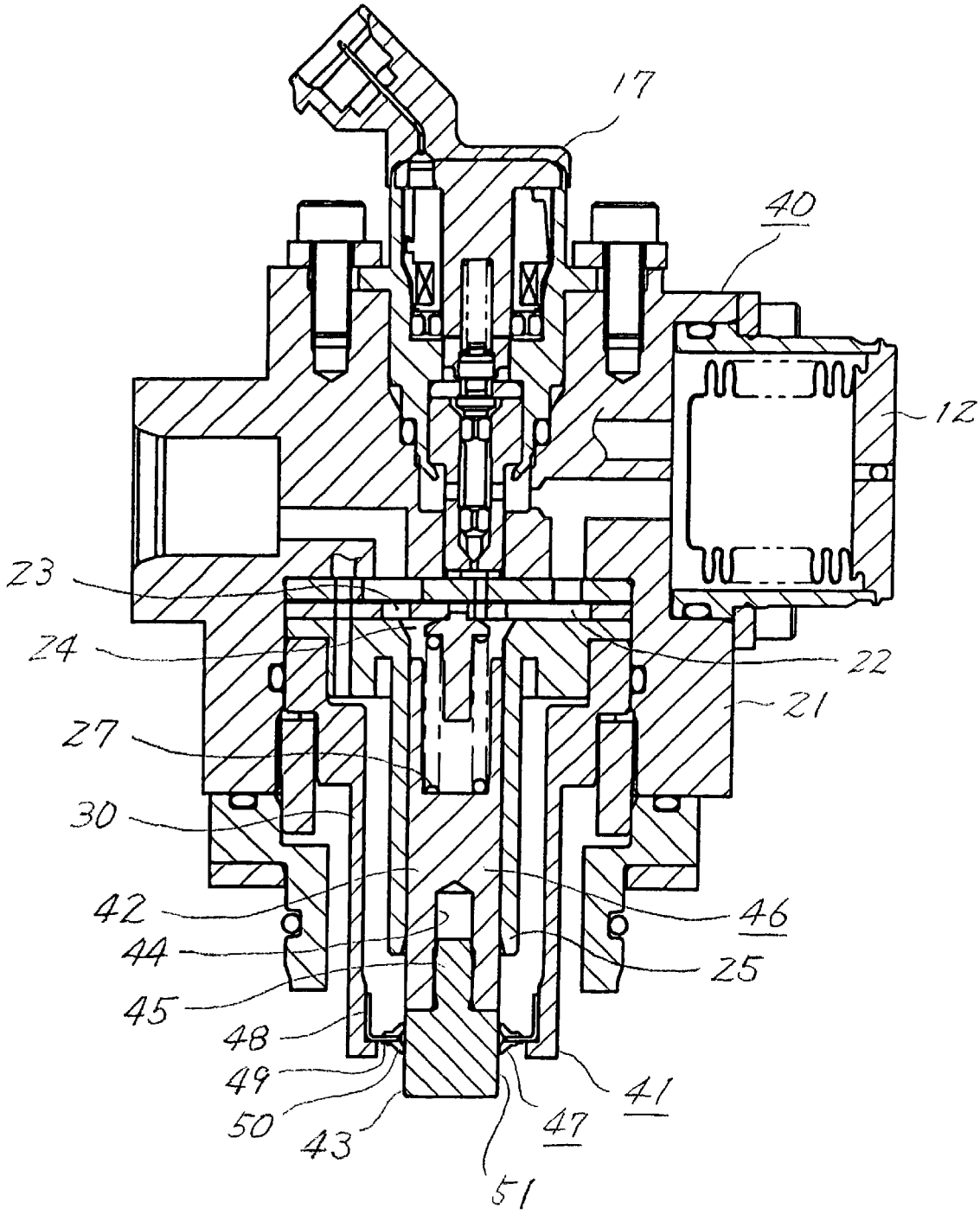
FIG. 1 is a longitudinal sectional view showing a high-pressure fuel supply apparatus as an exemplary embodiment of the present invention.

A pump 41 of the high-pressure fuel supply apparatus 40 shown in FIG. 1 according to the present invention is provided with a cylindrical sleeve, or the cylinder 25 that forms inside thereof the pressuring room 24 being accommodated within the casing 21 and having the suction port 22 and the discharge port 23 for fuel. Within the cylinder 25, a plunger 42 that is supported slidably in the line of the axis for making the volume the pressuring room 24 variable within the cylinder 25 is disposed, and the compression spring 27 is disposed at the inner end (the upper end in the Figure) of the plunger 42 and at the outer end (the lower end in the Figure) thereof a working member, or a tappet 43, for transmitting a driving force to the plunger 42 upon receiving the driving force from outside through an unillustrated engine camshaft is fitted and fastened. The tappet 43 is fitted in a central hole 44 formed at the tip of the plunger 42 in a way allowing a boss 45 to rotate relatively slackly around the central axis. The tappet 43 is assembled in a way preventing its coming off the plunger due to an unillustrated camshaft. Tool steel with improved hardness by a surface treatment and the like are suitable for forming the tappet 43, but alternatively it may be formed from ceramics. Thus, the plunger 42 supported within the cylinder 25 slidably so that the volume of the pressuring room 24 is variable and the tappet 43, or a working member, being made to have a relation with the plunger 42 for transmitting the driving force to the plunger 42 upon receiving the driving force from outside constitute a piston 46 of the high-pressure fuel supply apparatus 40.

The high-pressure fuel supply apparatus 40 also comprises a casing 30 for preventing the fuel leaking out of the space between the cylinder 25 and the piston 46 from leaking outside by surrounding substantially the cylinder 25 and the piston 46, and a sealing means made of rubber for sealing the space between the casing 30 and the piston 46. The sealing means 47 is a metal fixture with an L-shaped cross section having a cylindrical section 48 fastened to the tip of the cylinder-shaped casing 30 and a flange 49 formed integrally with the cylindrical section 48 and extending therefrom toward inside radially, to the inner edge of which a ring-shaped sealing rubber 50 with a Y-shaped cross section is fastened. In this way, the sealing means 47 fastened to the casing 30 and brought into a slidable contact with the tappet 43 of the piston 46 is sealing the space between the casing 30 and the piston 46.

Figure 4:
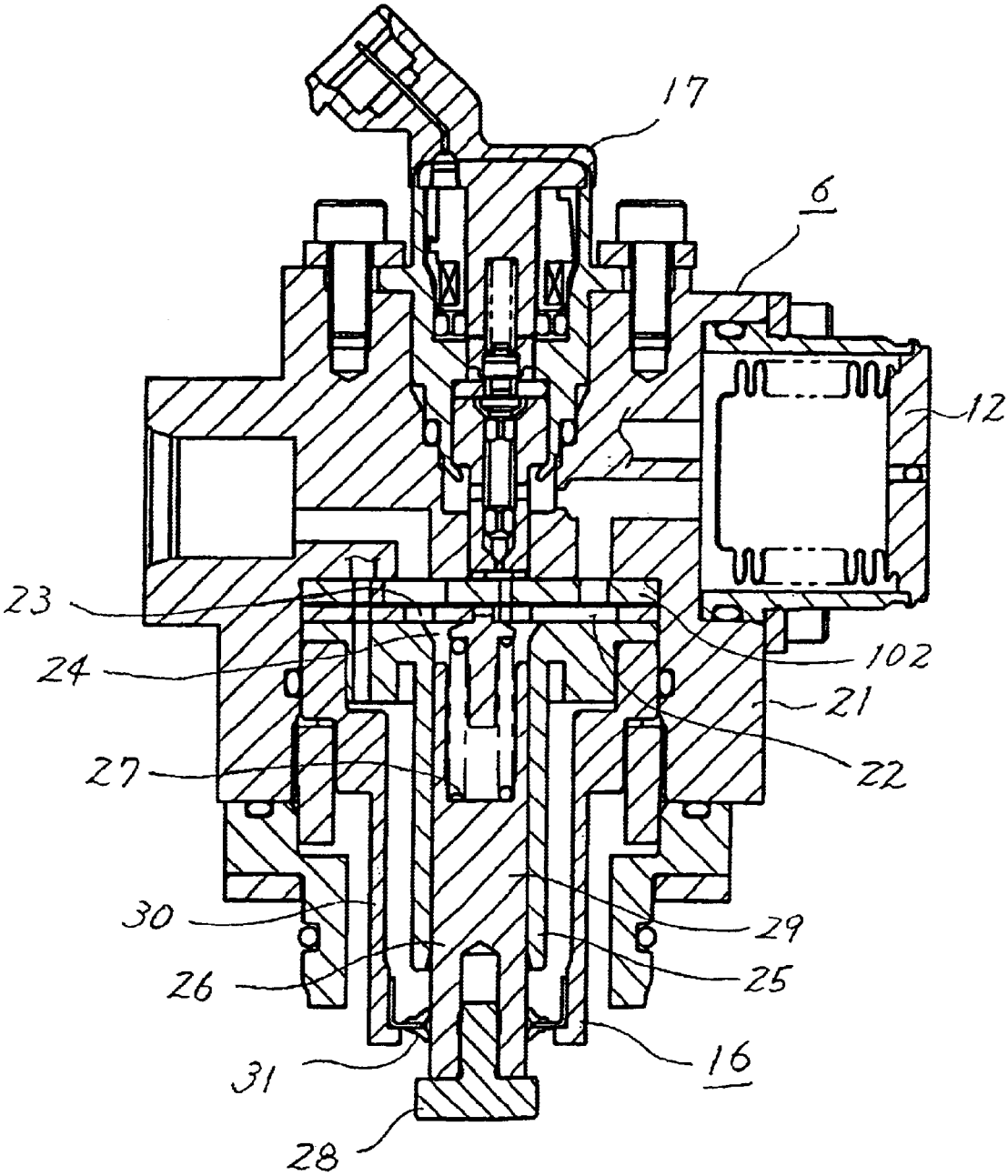
FIG. 4 PRIOR ART
FIG. 4 is a longitudinal sectional view of a conventional high-pressure fuel supply apparatus.

According to the present invention, the sealing rubber 50 of the sealing means 47 is not in contact with the plunger 42 of the piston 46 but in contact with a cylindrical surface of the outer boundary 51 of the tappet 43, or a working member fitted in the tip of the plunger 42. The tappet 43 is provided with a sliding surface that is longer than that of the conventional one shown in FIG. 4 so that a sealing relationship can always be kept with the sealing rubber 50 in spite of the reciprocation of the piston 46.

By a construction like this, in which the plunger 42 of the piston 46 and the tappet 43 are formed as separate independent parts in order that individual evaluations can be made for the respective parts, it is possible to evaluate separately only the sealing section between the tappet 43 and the sealing means 47, while keeping the abrasiveness with and seizure to the sleeve, or the cylinder 25, of the plunger 42 at the same level as that of the conventional high-pressure fuel supply apparatus 6. Further, lessening of restrictions as to the specification alteration on the side of the piston 46 becomes possible, and additionally it is possible to reduce the abrasion of the piston 46 and to cut significantly the evaluation time as well.

Figure 2:
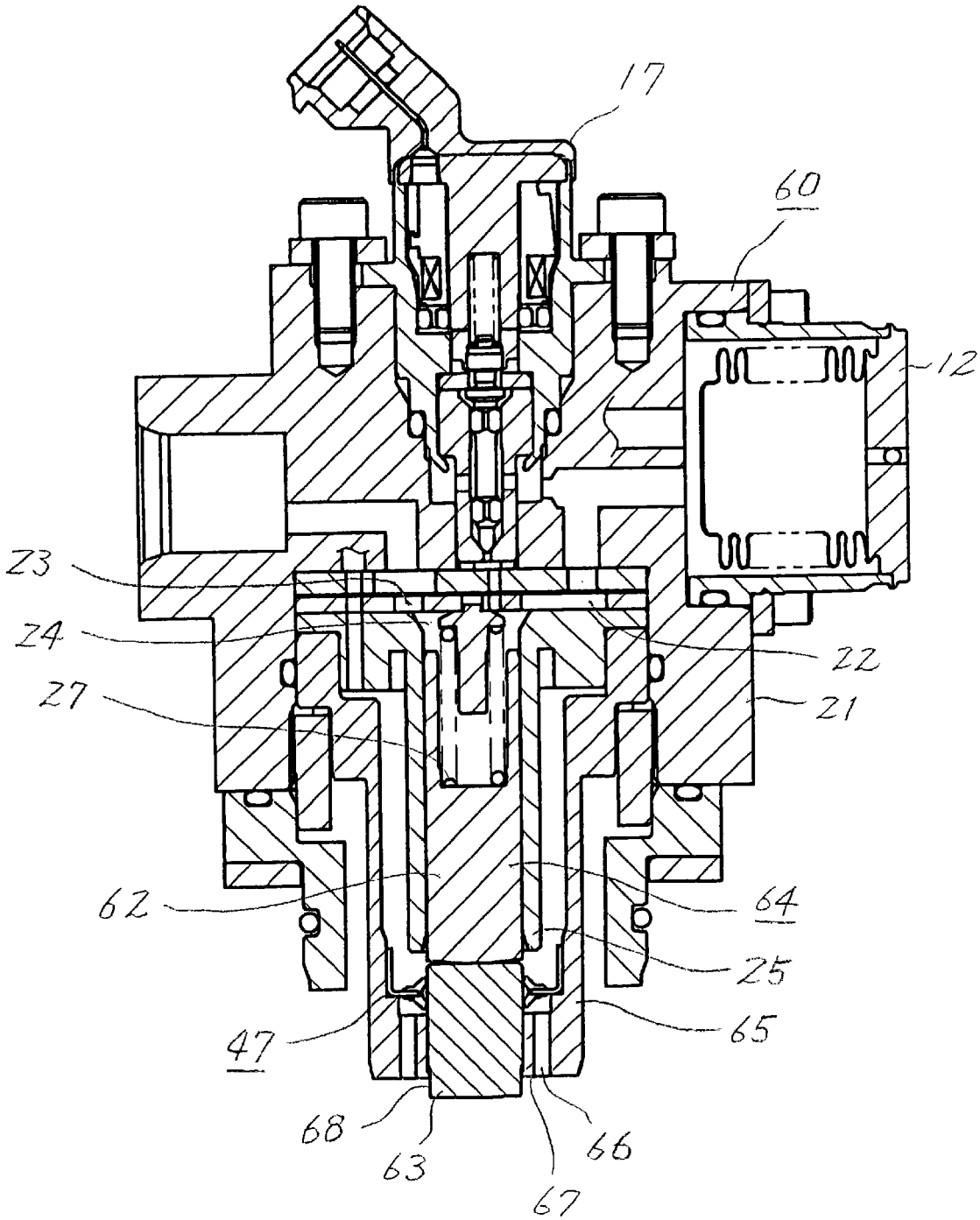
FIG. 2 is a longitudinal sectional view showing a high-pressure fuel supply apparatus as another exemplary embodiment of the of the present invention.
Figure 3:
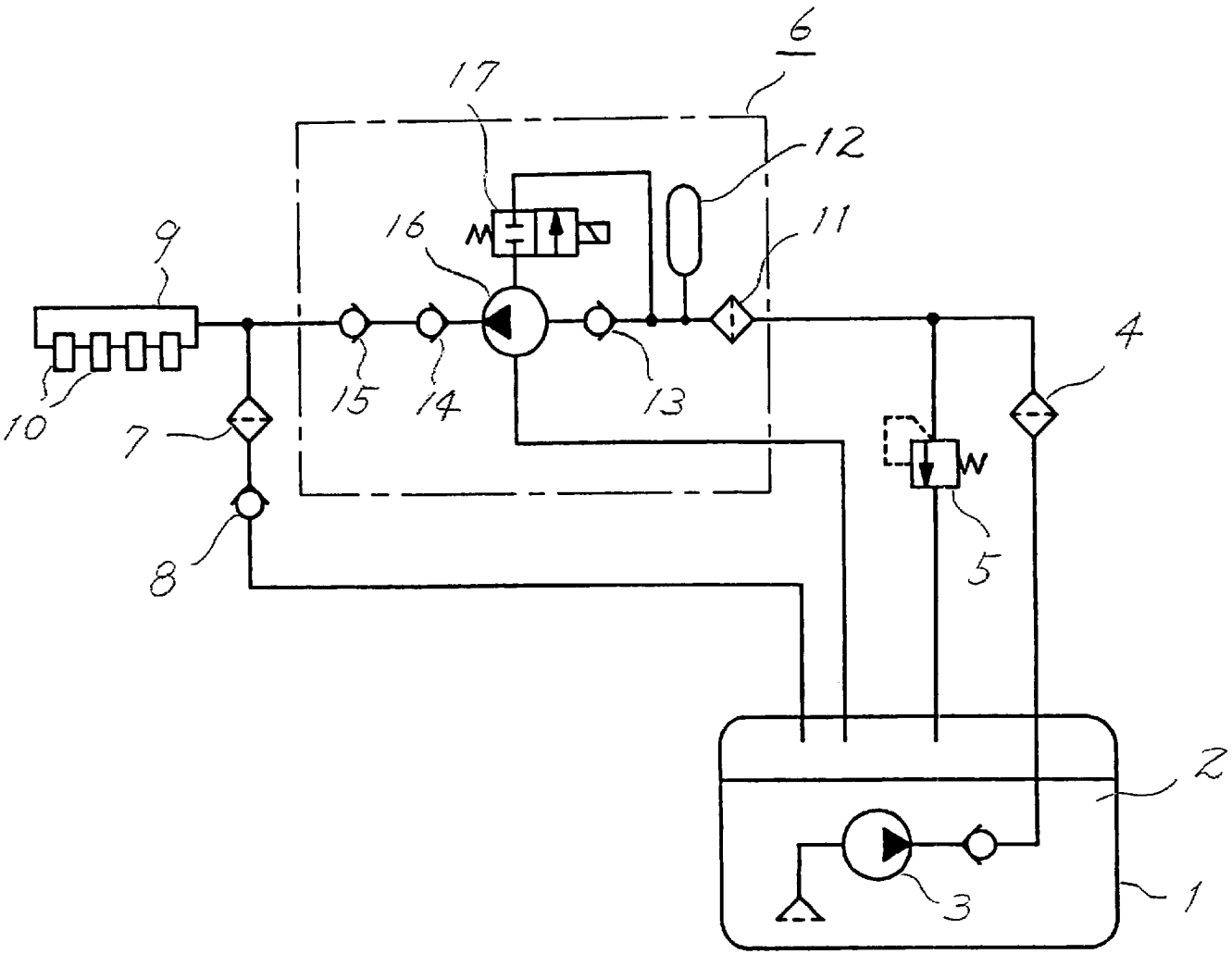
FIG. 3 is a schematic view of a typical fuel supply system to which the high-pressure fuel supply apparatus according to the present invention is applicable.

In the high-pressure fuel supply apparatus shown in FIG. 2, the tip of a plunger 62 is flat and no central hole like the central hole 44 of the exemplary embodiment shown in FIG. 1 is formed therein, and a tappet 63 for transmitting the action of the camshaft (not shown) to the plunger 62 is a columnar member with both ends being flat, which is disposed at one end of the plunger 62 not by fitting but by abutting simply. A piston 64 is constituted by the plunger 62 and the tappet 63. The column-shaped tappet 63 that is disposed at the tip of a casing 65 supported by the housing 21 with its cylindrical surface 68 being supported by a sliding bearing 67 having an axial opening 66 is supported in a way in which it can move axially but it does not move radially. The sealing means 47 that is identical with that shown in FIG. 1 is disposed at the inside of the sliding bearing 67 and holds a sealing relationship by being in contact with the cylindrical surface 68 of the tappet 63.

By a structure like this, it is possible to separate completely the tappet 63 including the sealing section from the plunger 62 since no rotating force of the camshaft (not shown) is transmitted from the tappet 63 to the plunger 62 because no fitting section is provided between the plunger 62 and the tappet 63 and the tappet 63 is just abutted against the plunger 62. Further, since the form of the tappet 63 is simple it is possible to use ceramics at a low cost.

Further, although the outer diameter of the tappet 63, particularly that of the sealing section can be set freely at any values in this structure, it is preferable that the outer diameter of the sealing section of the tappet 63 is set at the same value as that of the plunger 62 since noise could be heard on the side of the car body due to vibrations of the piping as a result of the generation of the pulses within the drain pipes because of a change in the volume of the drain room during the time of operation of the high-pressure fuel supply apparatus 60, if the sealing section has a diameter that is different from that of the plunger 62.

INDUSTRIAL APPLICABILITY

As described in the above, the high-pressure fuel supply apparatus according to the present invention is of use as a fuel supply apparatus in a fuel supply system of the fuel injection type in an internal combustion engine for automobiles.

What is claimed is:

1. A high-pressure fuel supply apparatus comprising;

a cylinder provided with a pressuring room having a suction port and an injection port for fuel;

a piston having a plunger that is supported within said cylinder slidably so that the volume of said pressuring room is variable and a working member being made to have a relation with said plunger for transmitting a driving force to said plunger upon receiving the driving force from outside;

a casing for preventing the fuel leaking out of the space between said cylinder and said piston from leaking outside by surrounding substantially said cylinder and said piston; and a sealing means for sealing the space between said casing and said piston, wherein said sealing means is fastened to said casing and brought into slidingly contact with said working member of said piston.

2. A high-pressure fuel supply apparatus as claimed in claim 1, wherein said working member is a tappet fitted in said plunger, and said sealing means is brought into slidingly contact with the cylindrical surface of said tappet.

3. A high-pressure fuel supply apparatus as claimed in claim 1, wherein said working member is a columnar member disposed at one end of the plunger by abutting and supported by said casing in a way in which it can move axially but it does not move radially.

4. A high-pressure fuel supply apparatus as claimed in claim 1, wherein said working member is a member made of ceramics.

* * * * *